US007070358B2

(12) United States Patent
Hicks

(10) Patent No.: US 7,070,358 B2
(45) Date of Patent: Jul. 4, 2006

(54) COMB GATE AND METHOD OF USE

(76) Inventor: Ron Hicks, P.O. Box 12187, Salem, OR (US) 97309

( * ) Notice: Subject to any disclaimer, the term of this patent is extended or adjusted under 35 U.S.C. 154(b) by 0 days.

(21) Appl. No.: 11/056,959

(22) Filed: Feb. 14, 2005

(65) Prior Publication Data

US 2005/0147468 A1 Jul. 7, 2005

Related U.S. Application Data

(63) Continuation of application No. 10/447,491, filed on May 28, 2003, now abandoned.

(51) Int. Cl.
*E01C 23/16* (2006.01)

(52) U.S. Cl. ..... 404/75; 404/94; 404/96; 404/97

(58) Field of Classification Search ..... 404/72, 404/75, 93, 94, 96, 97
See application file for complete search history.

(56) References Cited

U.S. PATENT DOCUMENTS 4,802,788 A * 2/1989 Smith ..... 404/94
5,387,051 A * 2/1995 Valente ..... 404/84.05

* cited by examiner

*Primary Examiner*—Gary S. Hartmann
(74) *Attorney, Agent, or Firm*—Carl D. Crowell

(57) ABSTRACT

An apparatus for applying a traffic stripe to a surface comprising a comb gate for permitting compound to be released from a tractive box through a comb for a contoured or profiled traffic stripe and a base gate for compound to be released for a standard or flat traffic stripe.

6 Claims, 2 Drawing Sheets

25
65
16
100
22
64
24
14
20
5
5

20

40

44
46

COMB GATE AND METHOD OF USE

CROSS-REFERENCE TO RELATED APPLICATIONS

This application is a continuation of and claims the benefit of the nonprovisional application Ser. No. 10/447,491 filed on May 28, 2003, now abandoned.

BACKGROUND OF THE INVENTION

The present invention relates to a comb gate for use in manufacturing a traffic stripe applied to a road surface and method of using the same. In particular, a comb gate for producing a traffic stripe having a profiled portion including a plurality of spaced grooves that provide improved night visibility and a raised profile that provides an audible indication of the presence of the line when a vehicle passes thereover, as well as improved visibility in wet or rainy conditions.

PRIOR ART

Road markings are generally made by using hot or cold traffic stripe paint, cold tape, or more durable materials such as epoxies or thermoplastics. Road markings generally come in two forms, long line stripes and transverse stripes. Long line stripes are typically four inches wide and include a solid line, an interrupted line, a pair of solid lines, or a solid line in combination with an interrupted line. The interrupted lines include a series of predetermined length traffic stripes separated by a series of predetermined length gaps. Interrupted lines are generally used with solid lines when center turn lanes (i.e., left-hand turn lanes in the United States) are applied, for example, to a three lane road. When two lines are used together, they are normally spaced four inches apart from each other. However, the spacing and dimensions of a traffic stripe can differ according to different country, state, country and city regulations.

Driving a motor vehicle during dry, daylight hours is a relatively simple task requiring one merely to obey the traffic signals and keep the vehicle within the proper traffic lane as defined by the markings on the road. This relatively simple task becomes a particularly exasperating and often treacherous assignment when darkness and wet weather conditions prevail. Under these conditions, the usual night driving handicap of reduced visibility is augmented by the wet weather conditions, thereby making traditional flat reflective road markings virtually imperceptible.

Generally, when stripes are applied, reflective materials may be added on top of the traffic stripe to give it increased reflectivity at night. The reflective material primarily consists of glass beads applied on top of the traffic stripe after the stripe has been applied to the road surface.

Water does not drain from conventional road markings during wet weather conditions. As a result, when it is raining, a thin film of water will form on top of the traffic stripe and significantly reduce the reflectivity of the striping material and the glass beads used therein. If a thick film of water forms on top of the traffic stripe, such as encountered in a heavy storm, the water will totally obscure the markings from view, thereby making them completely ineffective.

Because of the deterioration in traffic guidance conditions that occurs during dark and wet driving conditions, the incidence of traffic accidents increases and the usual smooth flow of traffic is impeded. Attempts have been made to eliminate these dangers by providing individual raised reflectors on the road surface, by using large reflective elements in road markings that protrude above the water film, and by forming profiled road markings having thickened transverse portions projecting above the water film.

One of the most widely used marking systems in the United States is an individual raised reflector, such as that available under the trade name Stimsonite™ 948 or that shown in U.S. Pat. No. 3,332,327. The reflector generally comprises an approximately four and one-half inch by two and one-half inch marker that is raised one-half inch from the road and has sloped side surfaces. A reflective panel is disposed on each of the sloped sides of the marker and the entire top surface is then covered with a plastic or glass coating. The markers are secured to the road using an epoxy glue or an adhesive, however, a problem with maintaining the markers on the road surface exists. For instance, on a hot summer day when the asphalt is especially soft, a heavy truck running over a marker will push it into the asphalt below the surface of the road. Heavy trucks also knock these markers off the road, thereby leaving a hole in place of the marker. In both instances, the effectiveness of the reflective marker is destroyed. The cost for such individual markers and their installation is also a significant drawback.

As an alternative to reflective markers, large glass beads have also been used to provide a profiled road marking having a pebble-like finish. In this system, produced by R.S. Clare & Co. Limited under the trade name Aquaflex.™, large one to four millimeter glass beads and small crushed stones are spread on top of a binder coat layer and then coated with paint. Smaller conventional reflective beads are then dispersed over the painted line. Portions of the large glass beads are able to protrude above thin water films on the road surface thereby providing a reflective surface. However, using this type of large glass bead substantially increases costs, and since the larger beads are not universally accepted for road marking, approval on a state by state basis is required. Further, because of their size, the large glass beads do not adhere well to the road marking and have a tendency to be dislodged by traffic.

Another marking system is generally described in U.K. Patent Application 2,121,462. This marking system uses a relatively thick striping material extruded through a shaped die. The striping is applied in a line approximately one and one-half to three millimeters thick and at intervals of every ten to fifty centimeters. The die is raised to increase the outflow of the striping material and thereby form a wavy transverse ridge approximately five to ten millimeters thick. The striping material generally includes glass beads mixed therewith and additional glass beads are preferably sprinkled on top of the applied marking before it is completely hardened. The spaced ridges form a profiled marking having raised reflective surfaces at specified intervals that will project above the surface of a water film and thereby provide visible markings during dark and wet weather conditions. However, the mechanical dye of this process requires an undulating dye head which can produce inconsistent thickness of striping and limit the available profile of any striping to a series of transverse ridges, providing for a limited profile.

A series of patents to Marcato, (the Marcato Patents), including U.S. Pat. Nos. 5,511,896, 5,114,268, and 5,642,962, use an apparatus that applies a thermoplastic stripe to the road surface, and a layer of reflective material to the thermoplastic stripe. The apparatus also passes a rotatable wheel having a plurality of projections around its periphery over the thermoplastic stripe such that the stripe is deformed and spaced grooves are formed therein. This process is very expensive and requires the use of costly heated thermoplastics, not suitable in all conditions.

A strong need therefore exists for a durable and economical way to apply road markings that are visible when wet, provide an audible signal to a driver when a vehicle passes there over, and have increased reflective properties to improve visibility in adverse conditions.

SUMMARY OF THE INVENTION

The apparatus of the present invention consist of a dynamic comb gate attached to a tractive box that may be used independently or attached to a vehicle. The invention is principally a dynamic comb gate for applying a cold-hardening compound to road surfaces. Such compounds are type sold under the trade name DURA-STRIPE™ and manufactured by TMT Pathway, of Salem, Oreg.

In use, a tractive box is filled with the compound to be applied, and longitudinally moved along the surface to be marked. The marking compound is extruded or released through a dynamic comb gate positioned proximate the surface to be marked.

The markings made are of 0.1 to 0.5 inches in thickness. For improve reflectivity the compound will often have glass or similar beads in the compound. To further improve reflectivity, additional beads may be applied to the surface of the compound prior to hardening.

The reflectivity of traditional traffic markings is limited by the constant cross section of the mark made. Water can easily cover the mark made limiting reflectivity. Further, traditional traffic markings present at most two faces to any observer, a vertical profile and the horizontal surface. Limited planar surface reduces the incidence of reflectivity to any observer.

A object of the present invention is to provide a traffic mark or stripe and method of producing the same which has increased visibility in wet conditions, presents a high degree of observability with low cost and ease of application. It is a further object of the present invention to provide a mark and method of producing the same which utilizes existing common mark producing compounds, readily available for use in the industry.

The present invention provides for a tractive box for applying marking lines consisting of a cold-hardening composition to surfaces. The tractive box is principally constructed of a composition well, with a forward wall, two side walls, a rear wall and a base. The tractive box is designed to be moved in a longitudinal direction and may be affixed to a vehicle or self propelled. The rearward facing rear wall has a dynamic comb gate comprised of a gate to open and close the tractive box proximate the surface to be marked and a die head or comb through which the compound is released.

The base has a second gate to provide a base line marking in the form of traditional tractive box marking.

The die head or comb is placed such that the marking compound is formed into a series of longitudinal ridges as the marking compound is extruded from the tractive box. The comb may be removable to permit alternate comb tooth patterns to be selected.

The resulting mark or traffic stripe produced consists of a linear stripe with a cross section that corresponds to the comb or die used with the tractive box and may contain three or more raised portions. The reflective qualities of the stripe may be further enhanced with the application of additional reflective material such as small glass beads.

BRIEF DESCRIPTION OF THE DRAWINGS

The above description and other objects, advantages, and features of the present invention will be more fully understood and appreciated by reference to the specification and accompanying drawings, wherein.

DETAILED DISCUSSION OF THE PREFERRED EMBODIMENTS

Figures 1, 2, 3, 4, 5, 6, 7:
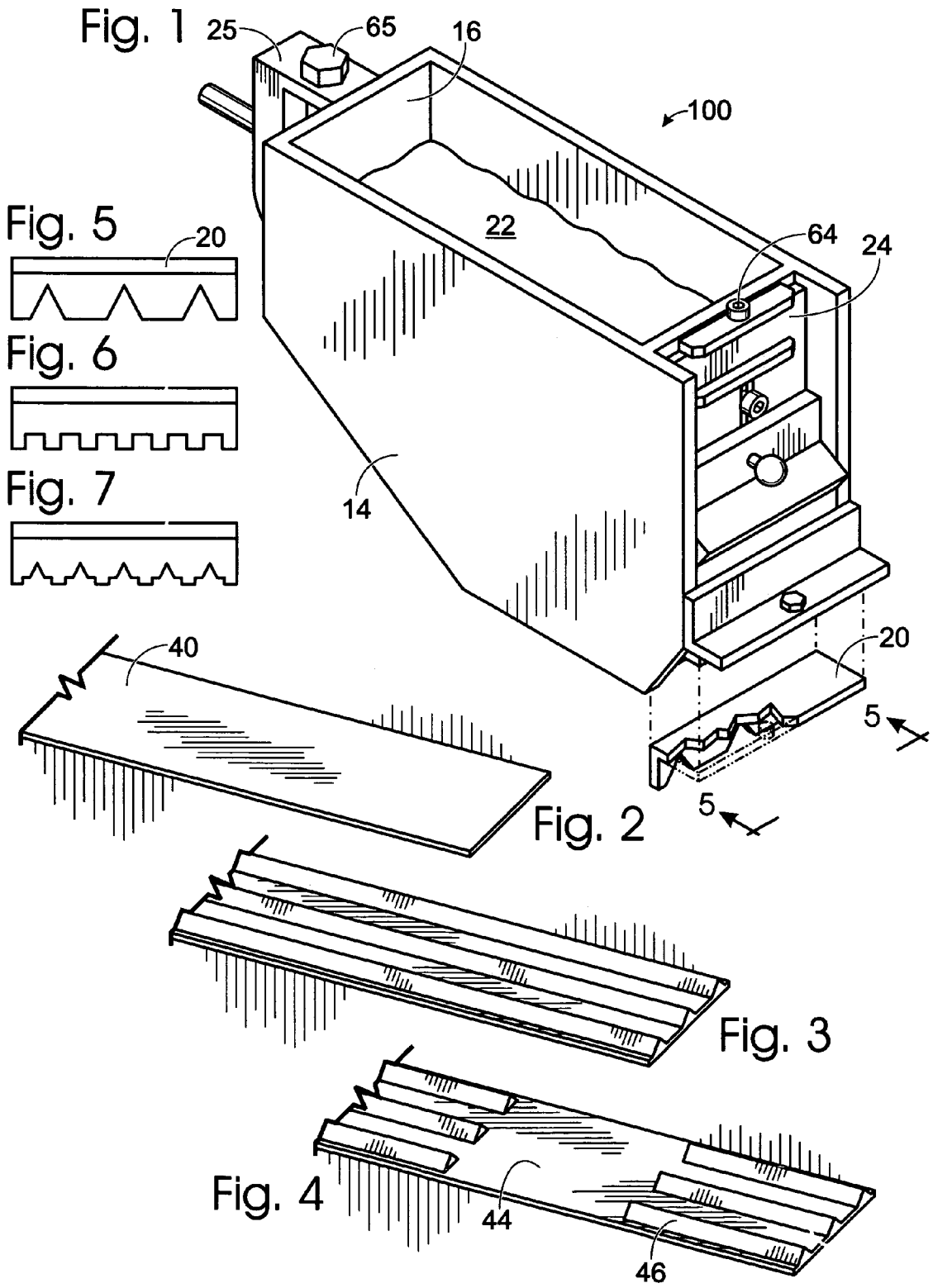
FIG. 1 is a perspective view of the preferred embodiment of a tractive box for applying a traffic stripe to a road in accordance with one embodiment of the present invention.
FIG. 2 is perspective view of one form of a traffic stripe produced in accordance with the present invention.
FIG. 3 is perspective view of another form of a traffic stripe produced in accordance with the present invention.
FIG. 4 is perspective view of another form of a traffic stripe produced in accordance with the present invention.
FIG. 5 is an elevation view of an alternate comb form.
FIG. 6 is an elevation view of an alternate comb form.
FIG. 7 is an elevation view of an alternate comb form.
Figure 8:
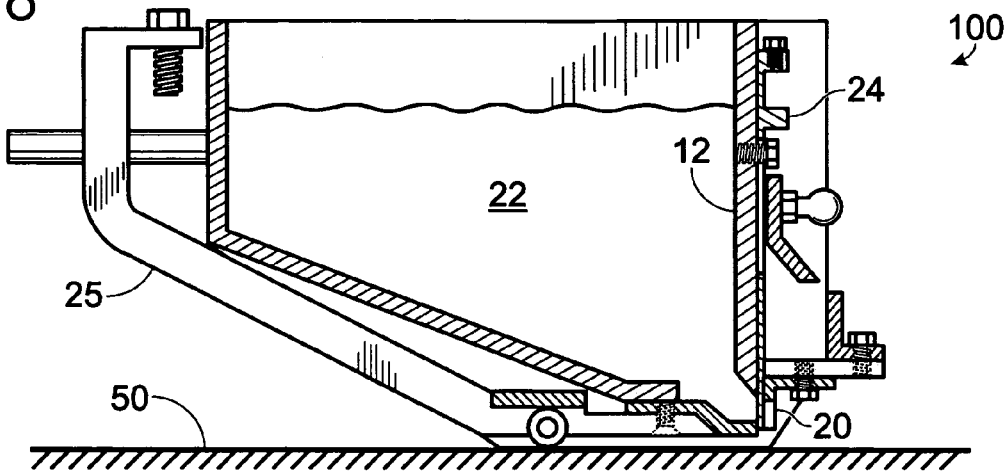
FIG. 8 is a side elevation view of the invention with all gates closed.

Referring to the figures, like elements retain their indicators throughout the several views. FIG. 1 depicts a perspective view of and embodiment of the invention with tractive box 100 for striping a roadway 50. The tractive box 100 comprising a pair of side walls 14, a rear wall 12, a front wall 16, and a base 18, all generally defining a composition well for holding a compound 22 to be deposited on a roadway 50.

Mounted to the rear wall 12 is a comb 20 that is preferably removable. Also mounted to the rear wall 12 proximate the base 18 is a comb gate 24 that is slideable relative to the rear wall 12. The comb gate 24 is disposed such that is may be slideably lifted so as to expose the comb 20 to the interior of the composition well and permit the compound 22 to flow through the comb 20. This slideable action may be accomplished through the attachment of an articulating means to a comb gate attachment point 64. Such articulating means (not depicted) may be manual, electromechanical, hydraulic or pneumatic or any of a large number of known forms.

Mounted to the base 18 is a base gate 25 which is slideable relative to the base 18. The base gate 25 is disposed such that is may be slideably retracted so as to expose the interior of the composition well and permit the compound 22 to flow onto a surface 50 to be striped or marked. This slideable action may be accomplished though the attachment of an articulating means to a base gate attachment point 65. Such articulating means (not depicted) may be manual, electromechanical, hydraulic or pneumatic or any of a large number of known forms.

In the preferred embodiment, the side walls 14 extend down below the base 18 and the base gate 25 such that there is a defined a volume when the tractive box 100 is placed on a surface 50. The volume contains the flow of the compound 22 when released by the base gate 25, and the portion of the side walls 14 which extend beyond the base 18 and the base gate 25 limit compound flow and define the width of the stripe 40 produced.

In operation the tractive box 100 is placed proximate a surface 50 to be striped or marked. The composition well is filled with compound 22 such as is marketed under the brand name DURA-STRIPE™. The tractive box is moved, drug or propelled along the surface 50. When marking is desired, one or both of the gates may be opened.

Figure 9:
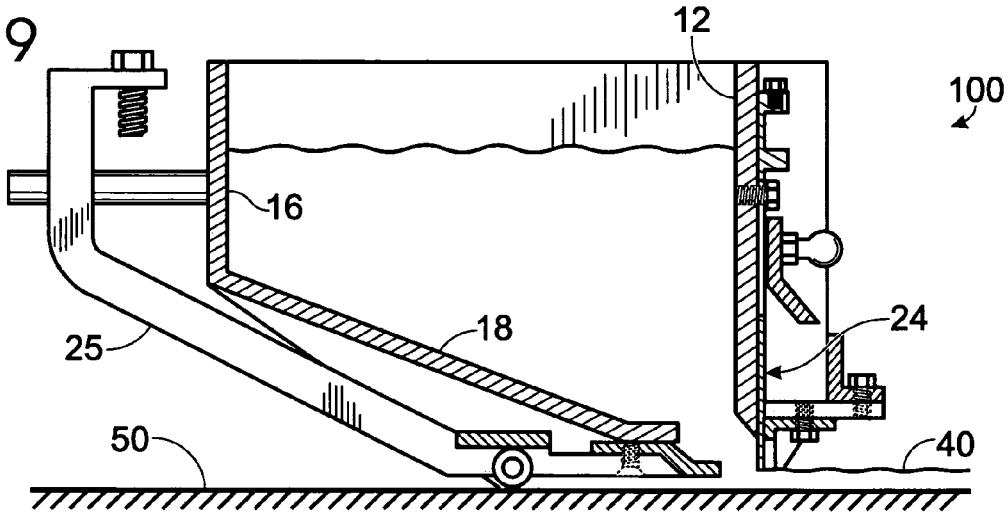
FIG. 9 is a side elevation view of the invention with the base gate open and the resulting stripe produced.

When a flat stripe 40 is desired as depicted in FIG. 2, the base gate is actuated to slide to the open position to permit the compound to flow from the composition well onto the surface 50 as depicted in FIG. 9. As the tractive box 100 is moved along the surface 50, the desired stripe 40 is produced.

A traditional broken stripe pattern may be created by selectively opening and closing the base gate 25 providing broken segments of stripe on a surface or roadway 50.

Figure 10:
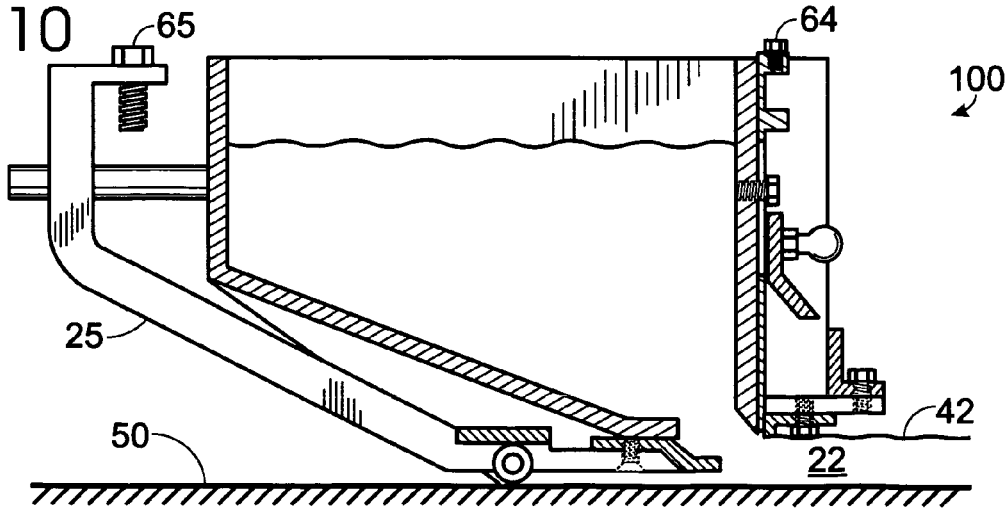
FIG. 10 is a side elevation view of the invention with the base gate and the comb gate open and the resulting stripe produced.

When a profiled stripe is desired as depicted in FIG. 3, the comb gate 24 is actuated to slide to the open position exposing the comb 20 and permitting the compound to flow through the comb 20 producing a profiled stripe 42 with a plurality of raised angled surfaces 46, as depicted in FIG. 10.

It is also disclosed and desirable to produce a stripe comprised of both profiled segments with raised angled surfaces 46 and flat segments 44. This may be accomplished though the intermittent opening and closing of the comb gate 24 as the tractive box 100 is moved along the surface 50 to be striped as depicted in FIG. 4.

Further, it is disclosed that both the comb gate 24 and the base gate 25 may be opened and closed together to produce intermittent profiled sections of striping when desired.

While the preferred comb 20 is comprised of four teeth as shown in FIGS. 1 and 5, creating a profiled stripe of three raised portions as depicted in FIGS. 3 & 4, alternate comb forms may be used to increase or alter the number and area of the profiled or angled surfaces as depicted in FIGS. 5, 6 & 7.

Wherein the terms and expressions which have been employed in the foregoing specification are used therein as terms of description and not of limitation, there is no intention, in the use of such terms and expressions, of excluding equivalents of the features shown and described or portions thereof, it being recognized that the scope of the invention is defined and limited only by the claims which follow.

I claim:

1. An apparatus for applying a traffic stripe to a surface comprising:

a tractive box with a base, a front wall, a pair of side walls and a rear wall defining a composition well, slidably mounted to said rear wall is a comb gate as to selectively occlude a comb disposed along said rear wall and proximate said base, slidably mounted to said base is a base gate as to selectively open said base permitting said composition well to be exposed to a surface to be striped.

2. The apparatus of claim 1 where in said comb is removably attached to permit alternate comb tooth patterns to be used.

3. A method of producing a dynamic surface stripe comprising:

providing proving a tractive box with a base, a front wall, a pair of side walls and a rear wall defining a composition well, slidably mounting to said rear wall is a comb gate as to selectively occlude a comb disposed along said rear wall and proximate said base, slidably mounting to said base is a base gate as to selectively occlude open said base permitting said composition well to be exposed to a surface to be striped, filling said composition well with a compound for use in striping, moving said tractive box linearly along a surface, opening said base gate to permit the release of said compound onto said surface.

4. The method of claim 3 comprising the further steps of opening said comb gate to permit the release of said compound onto said surface through said comb.

5. The method of claim 3 comprising the further steps of selectively opening and closing said comb gate to produce a stripe consisting of segments of low horizontal surface and segments of profiled surface.

6. The method of claim 3 comprising the further steps of selectively opening and closing both said comb gate and said base gate to produce a broken stripe consisting of spaced segments of profiled surface.

* * * * *